US007520661B1

(12) United States Patent
Lawson

(10) Patent No.: US 7,520,661 B1
(45) Date of Patent: Apr. 21, 2009

(54) STATIC MIXER

(75) Inventor: Jay R. Lawson, Clearwater, FL (US)

(73) Assignee: Aeromed Technologies LLC, Clearwater, FL (US)

( * ) Notice: Subject to any disclaimer, the term of this patent is extended or adjusted under 35 U.S.C. 154(b) by 174 days.

(21) Appl. No.: 11/602,168

(22) Filed: Nov. 20, 2006

(51) Int. Cl.
*B01F 5/06* (2006.01)

(52) U.S. Cl. ..... 366/340; 138/42

(58) Field of Classification Search ..... 366/176.1, 366/181.5, 336, 340, 341, DIG. 1, DIG. 2, 366/DIG. 3; 138/37, 42; 48/189.4
See application file for complete search history.

(56) References Cited

U.S. PATENT DOCUMENTS 2,618,539 A * 11/1952 Conta et al. ..... 48/189.4
4,135,180 A * 1/1979 White ..... 366/336
4,514,095 A * 4/1985 Ehrfeld et al. ..... 366/340
4,869,849 A * 9/1989 Hirose et al. ..... 261/78.2
5,672,821 A * 9/1997 Suzuki ..... 73/202
7,066,641 B2 * 6/2006 Honda ..... 366/340
2003/0165081 A1 * 9/2003 Mizutani et al. ..... 366/340

FOREIGN PATENT DOCUMENTS

JP 62176529 A * 8/1987

* cited by examiner

*Primary Examiner*—Charles E Cooley
(74) *Attorney, Agent, or Firm*—Ronald E. Smith; Smith & Hopen, P.A.

(57) ABSTRACT

A multi-stage restrictor includes an inlet plate, plates also being known as circular wafers, having a central non-restrictive aperture, a top fluid manipulation plate, an inter link plate, a bottom fluid manipulation plate and an exit plate disposed in stacked relation. An elongate channel interconnects pairs of circular lobes in the top and bottom fluid manipulation plates. In a multi-stage restrictor, a taper between five to ten degrees is formed in each of the channels of the top and bottom fluid manipulation plates. In a pressure spike attenuator, the taper is about fifteen to thirty degrees. In a static mixer, chevron-shaped protuberances are added to the tapered channels, one protuberance on each side of the each channel and each channel has a protuberance at its opposite end.

1 Claim, 9 Drawing Sheets

STATIC MIXER

BACKGROUND OF THE INVENTION

1. Field of the Invention

This invention relates, generally, to micro-fluidic control. More particularly, it relates to means for controlling flow in ultra low flow regimes involving small passages.

2. Description of the Prior Art

Conventional machining methods can make a flow passage having a diameter of 0.001 inch. Although technically possible, practically such small single holes become clogged easily by contamination.

One known technique is to provide a series of nested large passages to create the effect of a single, much smaller hole. More particularly, a series of flow chambers is patterned into a circular wafer form, also called a plate. Each flow chamber includes two opposing circular lobes connected by a long, narrow rectangular channel. This technique has utility in hydraulic systems where very low flow passages that are not contamination sensitive are required.

This prior art design employs parallel rectangular channel lines tangentially connecting diametrically opposed circular lobes. Entering fluid meets an abrupt pressure drop at an initial flow chamber where an initial lobe exits to a far more narrow entry to a rectangular interconnecting passage. For flow restrictors, an abrupt pressure drop can cause cavitation or pseudo-cavitation, i.e., an entrained air release. Either way, babbles may release into fluid channels causing hydraulic action to become "spongy," i.e., to have lessened hydraulic effectiveness. Hydraulics depends upon the use of incompressible fluid to transmit power. Accordingly, air mixed into hydraulic oil lessens hydraulic effectiveness by making the fluid more compressible.

Pressure spike attenuators, also known as snubbers, are designed to cancel pressure spikes upon entry into pressure transducers. Pressure spikes, whether created by a severe pump ripple or water hammer effects, are damaging to fluid system components such as pressure transducers that contain sensitive electronics.

What is needed, then, is an improved micro-fluidic control means that inhibits or eliminates bubble formation by reducing or eliminating abrupt pressure drops, thereby increasing hydraulic effectiveness.

There is a need as well for improvements in pressure spike attenuators and static mixers.

However, in view of the prior art taken as a whole at the time the present invention was made, it was not obvious to those of ordinary skill how the identified needs could be fulfilled.

SUMMARY OF THE INVENTION

The long-standing but heretofore unfulfilled need for a means for improvements in micro-fluidic controls is now met by a new, useful, and non-obvious invention.

In a first embodiment, a multi-stage restrictor includes an inlet plate having a central non-restrictive aperture formed therein, a top fluid manipulation plate, an inter link plate having a plurality of non-restrictive apertures formed therein about the periphery thereof, a bottom fluid manipulation plate, and an outlet plate having a central non-restrictive aperture formed therein. A plurality of circular lobes is formed in the top and bottom fluid manipulation plates and an elongate channel interconnects contiguous pairs of the circular lobes. Each of the elongate channels has a taper formed therein so that the elongate channels reduce in width along their respective extents. The taper is about five to ten degrees (5-10°) and results in abrupt pressure drops having a more graduated progressive drop.

In a second embodiment, a pressure spike attenuator includes an inlet plate, a top fluid manipulation plate, an inter link plate, a bottom fluid manipulation plate, and an outlet plate. The top and bottom fluid manipulation plates respectively include a plurality of circular lobes and an elongate channel interconnecting contiguous pairs of the circular lobes. Each of the elongate channels has a taper formed therein so that the elongate channels reduce in width along their respective extents. The taper is about fifteen to thirty degrees (15-30°) and more effectively entraps and cancels a wider range of incoming pulsations of varying amplitude and frequency.

In a third embodiment, a static mixer includes an inlet plate, a top fluid manipulation plate, an inter link plate, a bottom fluid manipulation plate, and an outlet plate. The top and bottom fluid manipulation plates respectively include a plurality of circular lobes and an elongate channel interconnects contiguous pairs of the circular lobes. Each of the elongate channels has a taper formed therein so that the elongate channels reduce in width along their respective extents. A plurality of chevron-shaped protuberances is formed in each channel of said plurality of channels at opposite ends thereof and on opposing sides thereof.

Advantageously, the novel multi-stage restrictor inhibits abrupt pressure drops. The novel pressure spike attenuator effectively cancels out incoming pressure spikes, and the novel static mixer enhances the mixing effect of the micro-fluids.

These and other advantages will become apparent as this disclosure proceeds. The invention includes the features of construction, arrangement of parts, and combination of elements set forth herein, and the scope of the invention is set forth in the claims appended hereto.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
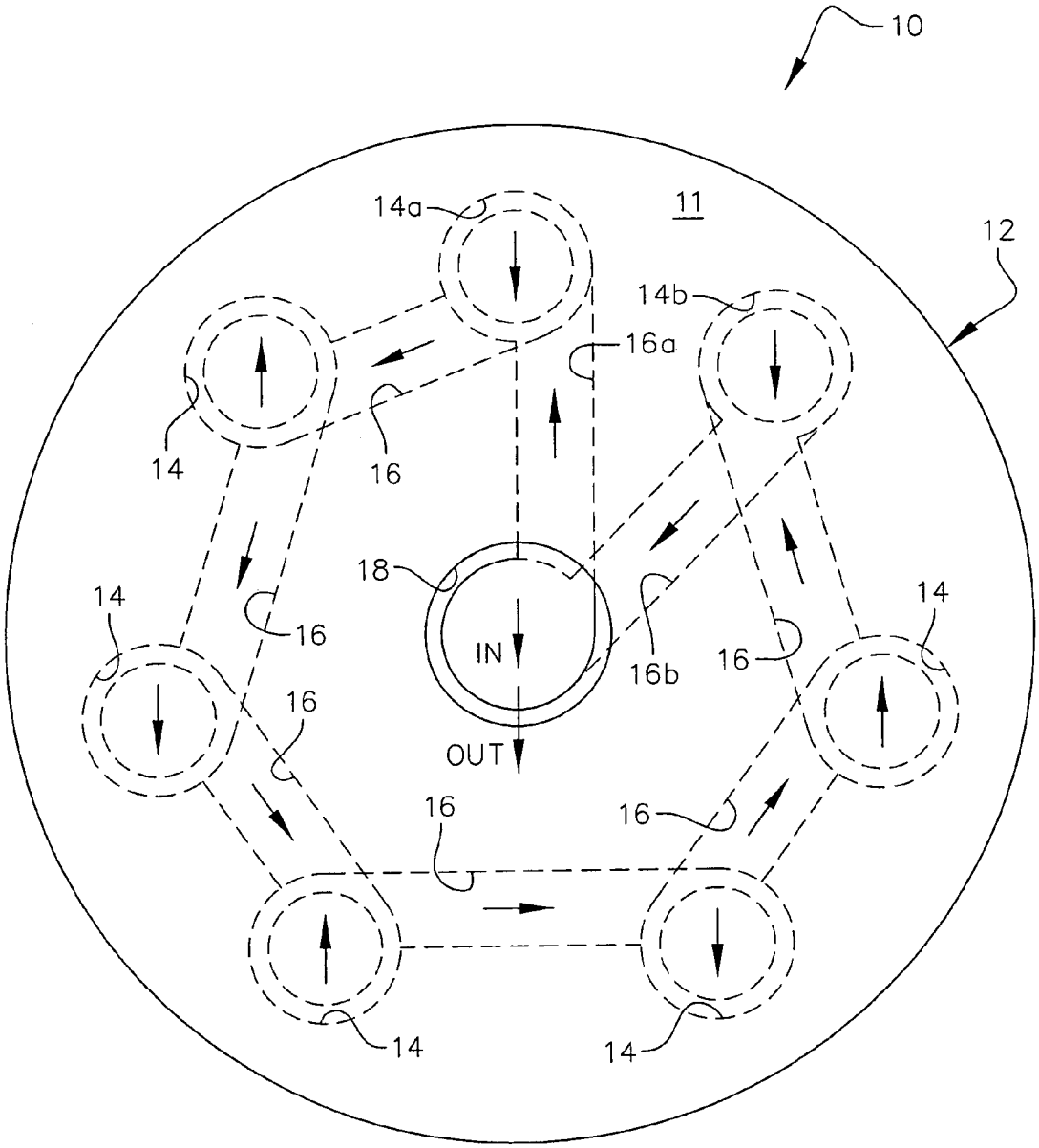
FIG. 1 (PRIOR ART)
FIG. 1 is a top plan view of a prior art micro-fluidic flow control device formed by stacking a plurality of flow chambers.

Referring now to FIG. 1, it will there be seen that a prior art micro-fluidic flow control device 10 includes multiple flow chambers 12 in stacked relation to one another. Each flow chamber is formed on a circular wafer or plate 11. Each flow chamber 12 includes a pair of circular lobes, collectively denoted 14, interconnected by an elongate, narrow rectangular channel, collectively denoted 16. Each channel 16 is straight so that each set of contiguous circular lobes 14 is formed by a pair of circular lobes that are disposed one hundred eighty degrees (180°) apart. Parallel rectangular channel lines tangentially connect one hundred eighty degree-opposed circular lobes, i.e., circular lobes 14 are circumferentially spaced apart from one another about the periphery of wafer 10 and are disposed in surrounding relation to central opening 18. Each channel 16 has a width common to that of the other channels and all channels are of uniform width along their respective extents.

More particularly, circular lobe 14*a* is in fluid communication with central opening 18, as is circular lobe 14*b*. Fluid is thus understood to flow from central hole 18 through rectangular channel 16*a* to circular lobe 14*a* and from there to each contiguous lobe in a clockwise direction as drawn until it arrives at circular lobe 14*b*. The fluid then flows from said circular lobe 14*b* through rectangular channel 16*b* into central hole 18. In this way, fluid flowing out of central hole 18 in a first direction has an extended path of travel before it returns to said central hole flowing in a second direction opposite to said first direction.

It should be understood that FIG. 1 is a composite view in that it includes a plurality of flow chambers in stacked relation to one another.

Figure 2:
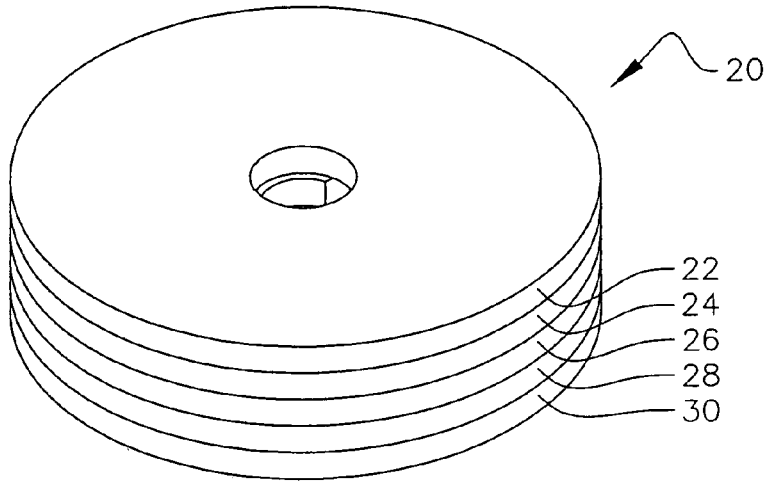
FIG. 2 is a perspective view of the novel multi-stage restrictor.

Referring now to FIG. 2, it will there be seen that a first illustrative embodiment of the invention is denoted as a whole by the reference numeral 20. Novel multi-stage restrictor 20 includes inlet plate 22, top fluid manipulation plate 24, inter link plate 26, bottom fluid manipulation plate 28, and exit or outlet plate 30. Each of said plates is a flow chamber and thus it is clear that said five (5) flow chambers are stacked to form the novel multi-stage restrictor.

Figure 3:
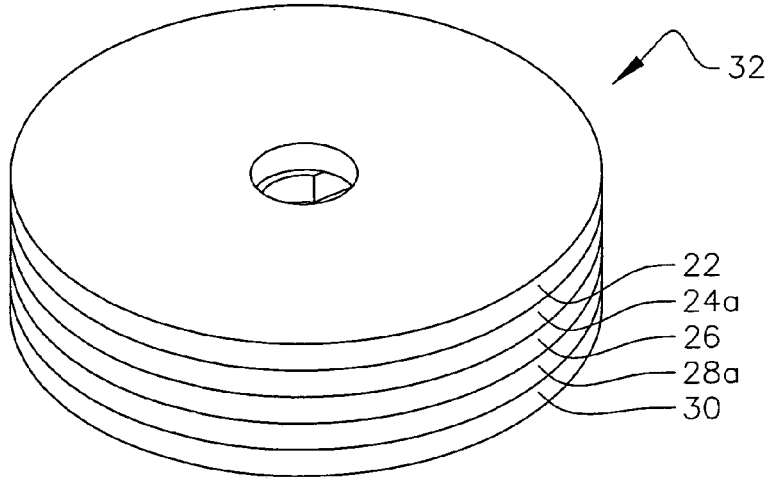
FIG. 3 is a perspective view of the novel pressure spike attenuator.

As depicted in FIG. 3, a second illustrative embodiment of the invention is denoted as a whole by the reference numeral 32. Novel pressure spike attenuator 32 includes inlet plate 22, top fluid manipulation plate 24*a*, inter link plate 26, bottom fluid manipulation plate 28*a*, and exit or outlet plate 30. Each of said plates is a flow chamber and thus it is clear that said five (5) flow chambers are stacked to form the novel pressure spike attenuator.

Figure 4:
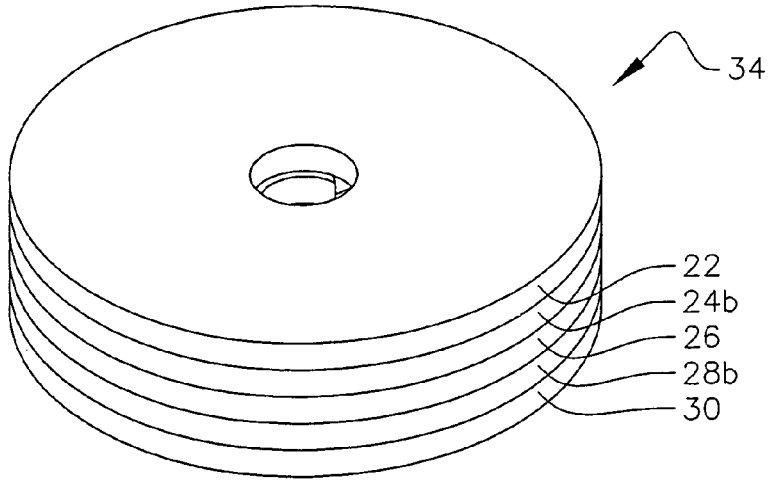
FIG. 4 is a perspective view of the novel static mixer.

FIG. 4 depicts a third illustrative embodiment of the invention, denoted as a whole by the reference numeral 34. Novel static mixer 34 includes inlet plate 22, top fluid manipulation plate 24*b*, inter link plate 26, bottom fluid manipulation plate 28*b*, and exit or outlet plate 30. Each of said plates is a flow chamber and thus it is clear that said five (5) flow chambers are stacked to form the novel static mixer.

Thus it is understood that the three embodiments include an inlet plate 22, an inter link plate 26, and an exit or outlet plate 30 of common construction. Said embodiments differ in that the top and bottom fluid manipulation plates for the multi stage restrictor, the pressure spike attenuator, and the static mixer differ from one another.

Figure 5:
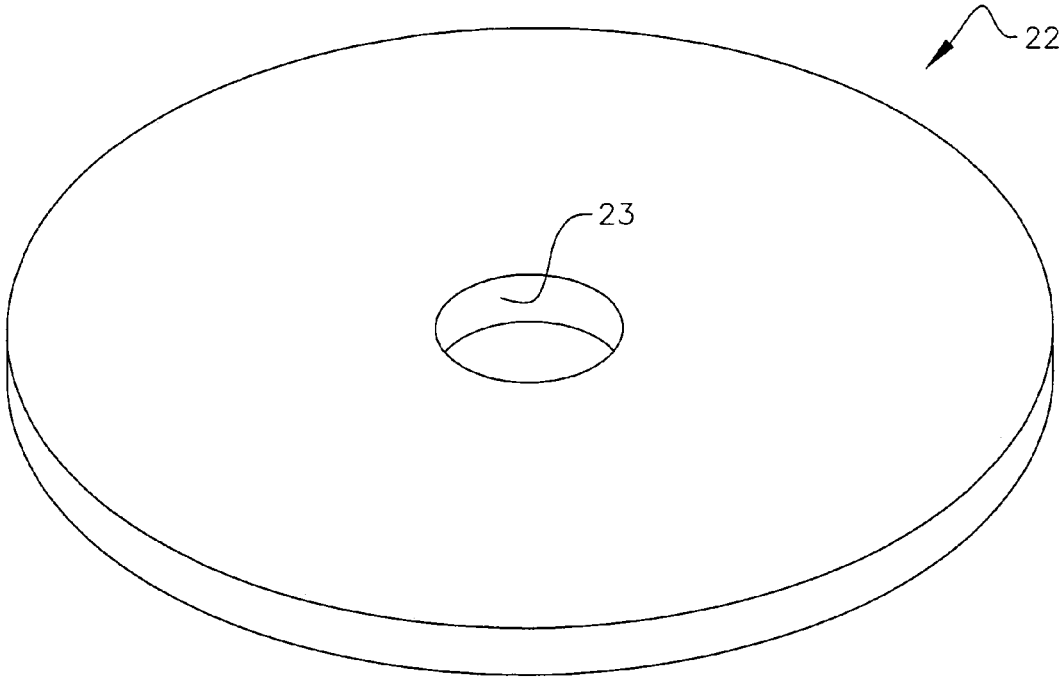
FIG. 5 is a perspective view of the novel inlet plate and of the novel exit plate for the assemblies of FIGS. 2-4.

Inlet plate 22, having the same construction as exit plate 30 as aforesaid, is depicted in FIG. 5. It is used in all three embodiments. Inlet plate 22 is circular and has a diameter of about 0.125 inch and a thickness of about 0.01 inch. A central non-restrictive aperture 23 is formed in said inlet plate 22. Aperture 23 is the fluid entry hole. Inlet plate 22, also known as the top entry plate, has the same construction in all designs of the same size or class.

Figure 6:
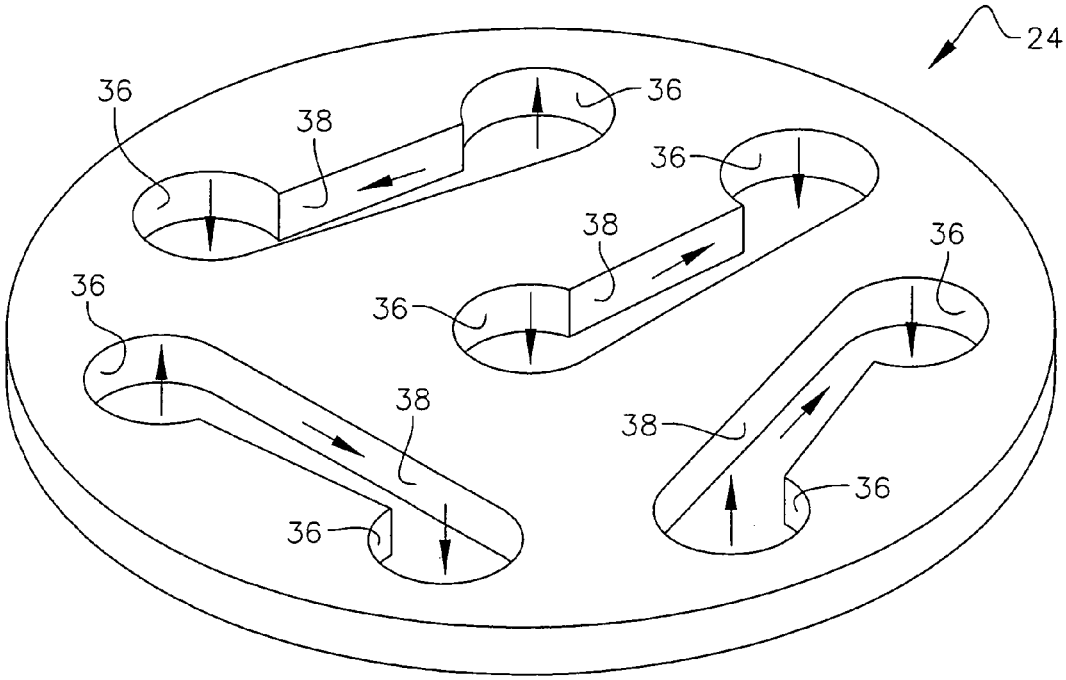
FIG. 6 is a perspective view of the novel top fluid manipulation plate for the multi-stage restrictor of FIG. 2.

Top fluid manipulation plate 24 for multi-stage restrictor 20 is depicted in FIG. 6. A plurality of circular lobes, collectively denoted 36, are interconnected to one another in pair groupings by elongate channels, collectively denoted 38 but said pair groupings or circular lobes are not interconnected to one another. Moreover, channels 38 are not rectangular but are tapered. The taper is between about five to ten degrees (5-10°) so that elongate channels 38 are reduced in width as depicted along their respective extents. This diminishes the propensity for bubble-creating abrupt pressure drops created by the prior art structure.

In FIG. 6, fluid flow direction is indicted by directional arrows. An upwardly pointing arrow denotes upward fluid flow and a downward pointing arrow denotes downward fluid flow.

Figure 7:
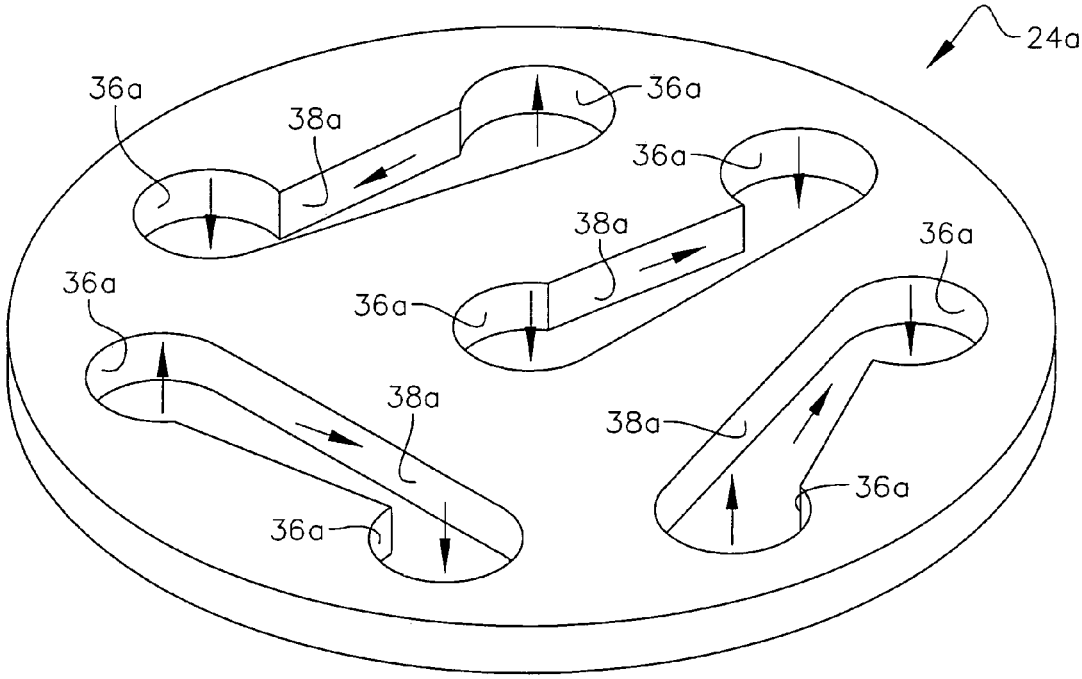
FIG. 7 is a perspective view of the novel top fluid manipulation plate for the pressure spike attenuator of FIG. 3.

Top fluid manipulation plate 24*a* for pressure spike attenuator 32 is depicted in FIG. 7. In top fluid manipulation plate 24*a* there are a plurality of circular lobes, collectively denoted 36*a*, that are interconnected to one another in pair groupings by elongate channels, collectively denoted 38*a*, of tapered width. As in top fluid manipulation plate 24, the pair groupings of circular lobes 36*a* of pressure spike attenuator 32 are not interconnected to one another. The taper or each rectangular channel 38*a* is between about fifteen to thirty degrees (15-30°) so said elongate channels 38*a* are reduced in width as depicted along their respective extents. This taper, being more severe than the taper of the channels formed in top fluid manipulation plate 24, more effectively entraps and cancels a wider range of incoming pulsations of varying amplitude and frequency. The angle will vary among differing applications.

Figure 8:
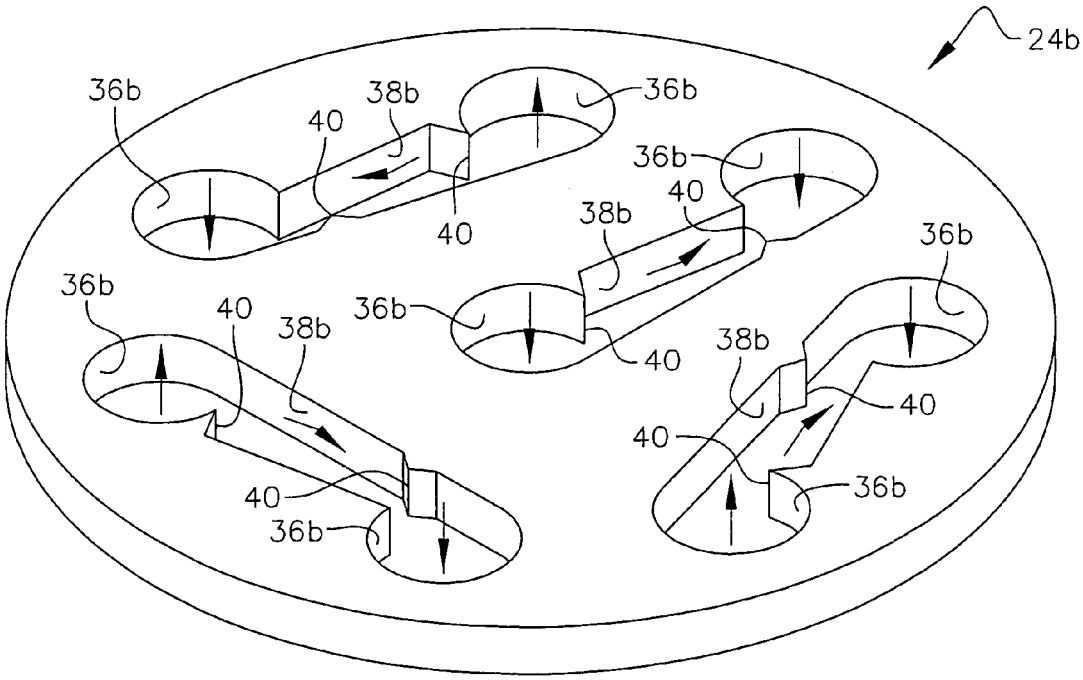
FIG. 8 is a perspective view of the novel top fluid manipulation plate for the static mixer of FIG. 4.

Top fluid manipulation plate 24*b* for static mixer 34 is depicted in FIG. 8. In top fluid manipulation plate 24*b* there are a plurality of circular lobes, collectively denoted 36*b*, that are interconnected to one another in pair groupings by elongate channels, collectively denoted 38*b*, of tapered width. The taper or each rectangular channel 38*b* is between about fifteen to thirty degrees (15-30°) so said elongate channels 38*b* are reduced in width as depicted along their respective extents. As in the top fluid manipulation plates 24 and 24*a*, the pair groupings of circular lobes 36*b* of top fluid manipulation plate 24*b* are not interconnected to one another. Wedge or chevron-shaped protuberances, collectively denoted 40, are formed in each channel 38*b* at opposite ends thereof and on opposing sides thereof. Each protuberance 40 is positioned contiguous to a circular lobe 36*b*.

Figure 9:
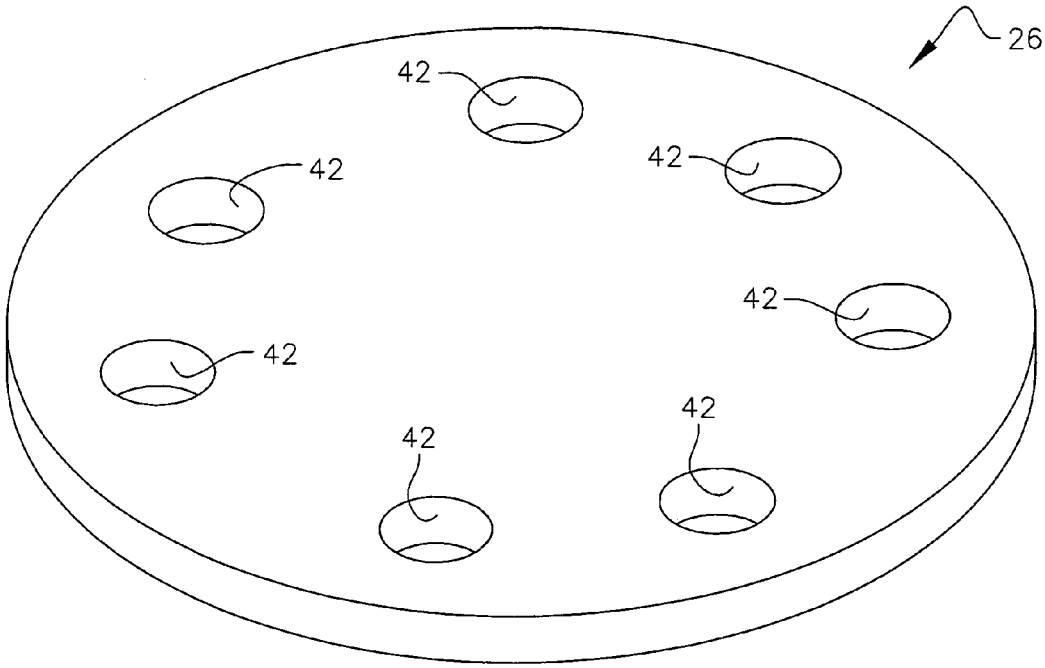
FIG. 9 is a perspective view of the novel inter link plate for the assemblies of FIGS. 2-4.

Interlink plate 26, common to all three embodiments as aforesaid, is depicted in FIG. 9. It is formed of a circular wafer or plate having a plurality of non-restrictive apertures, collectively denoted 42, formed therein about the periphery thereof. Interlink plate 26 connects the upper flow channels to the lower set of flow channels. It also allows the flow channels to maintain a serial flow path and allows the beginning and end point of each series to end in the center. This design facilitates the stacking of plates sets for desired effects, such as increased restriction, increased mixing, etc. The hole size of the interlink plate's respective holes 42 remains constant for pressure attenuator and mixing applications. The hole size varies for restriction applications to expand the application range of the design.

Figure 10:
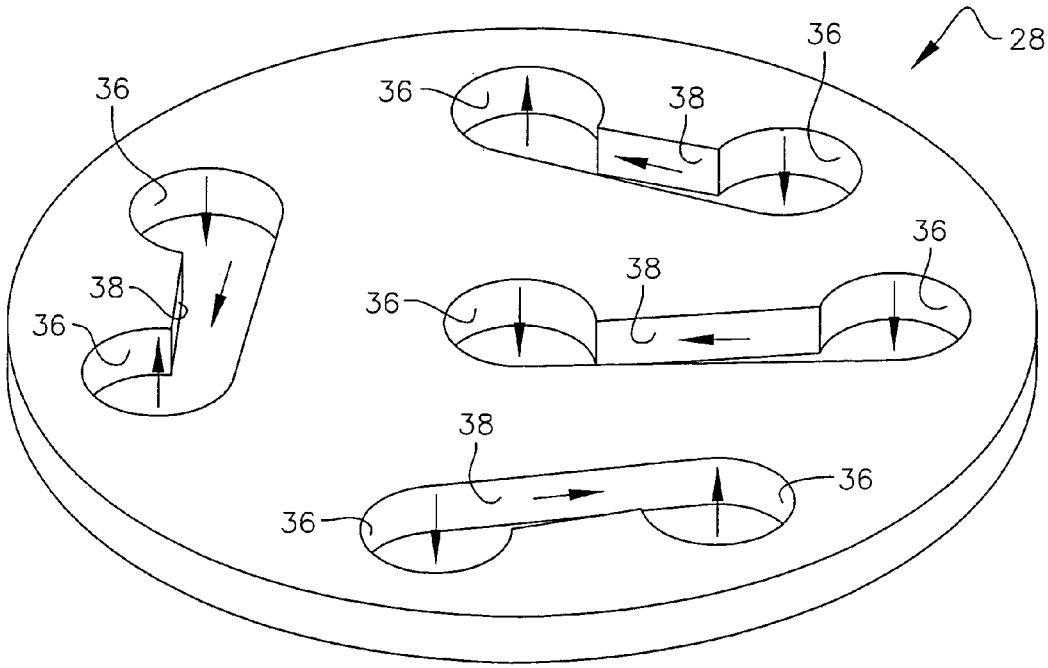
FIG. 10 is a perspective view of the novel bottom fluid manipulation plate for the multi-stage restrictor of FIG. 2.
Figure 11:
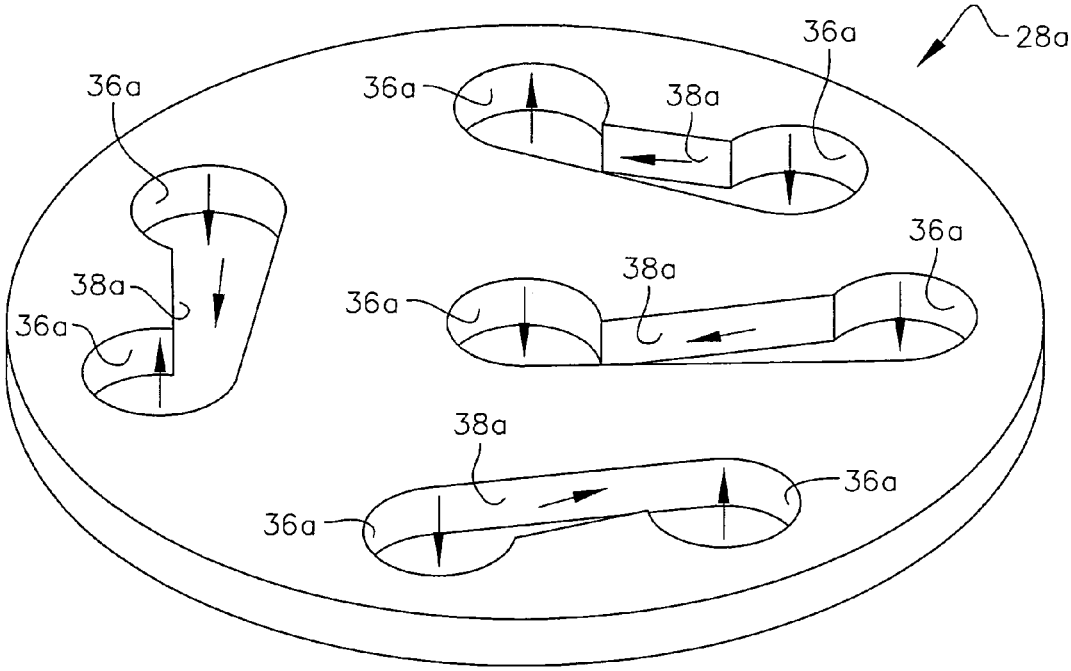
FIG. 11 is a perspective view of the novel bottom fluid manipulation plate for the pressure spike attenuator of FIG. 3.
Figure 12:
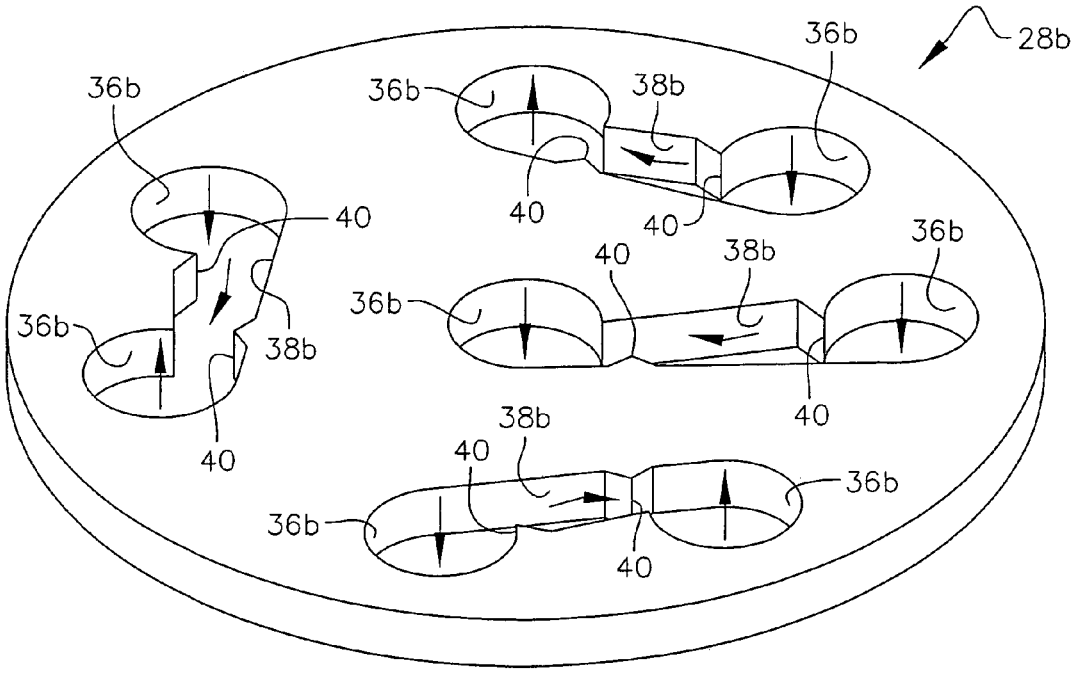
FIG. 12 is a perspective view of the novel bottom fluid manipulation plate for the static mixer of FIG. 4.

The bottom fluid manipulation plates 28, 28*a*, and 28*b*, respectively, for the multi-stage restrictor, pressure spike attenuator, and static mixer, are depicted in FIGS. 10-12. They share a substantially common construction with their respective top fluid manipulation plates 24, 24*a*, and 24*b* for said multi-stage restrictor, pressure spike attenuator, and static mixer, respectively, as indicated by the common reference numerals. It includes flow channels similar in design and principle as those in top fluid manipulation plates 24, 24*a*, and 24*b*, but is different in actual size to allow for a continuous compact serial flow path, thereby bringing the flow back to center at the end of a series.

The bottom exit plate 30 for each of said three embodiments shares a common construction with inlet plate 22 of said three embodiments, depicted in FIG. 2. Said bottom exit plate is therefore not separately depicted. The fluid can exit the flow cell i.e., the plate series, at bottom exit plate 30 and flow to other points in a fluid system or enter a second plate positioned therebelow. A series of flow cells may be interconnected to achieve proper restriction, proper pressure spike attenuation, or proper mixing.

Figure 13:
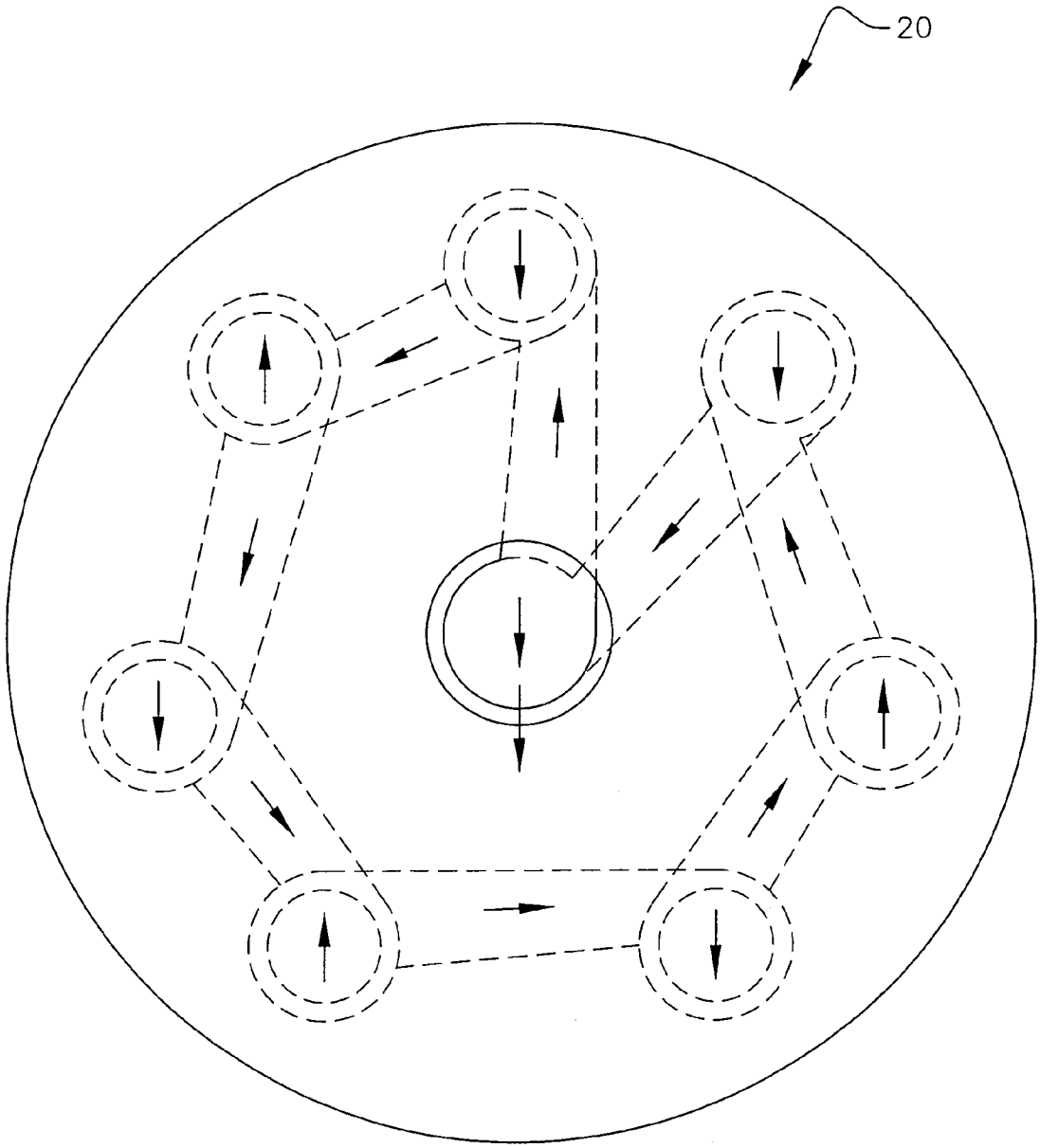
FIG. 13 is a top plan view depicting the flow path of the novel multi-stage restrictor.
Figure 14:
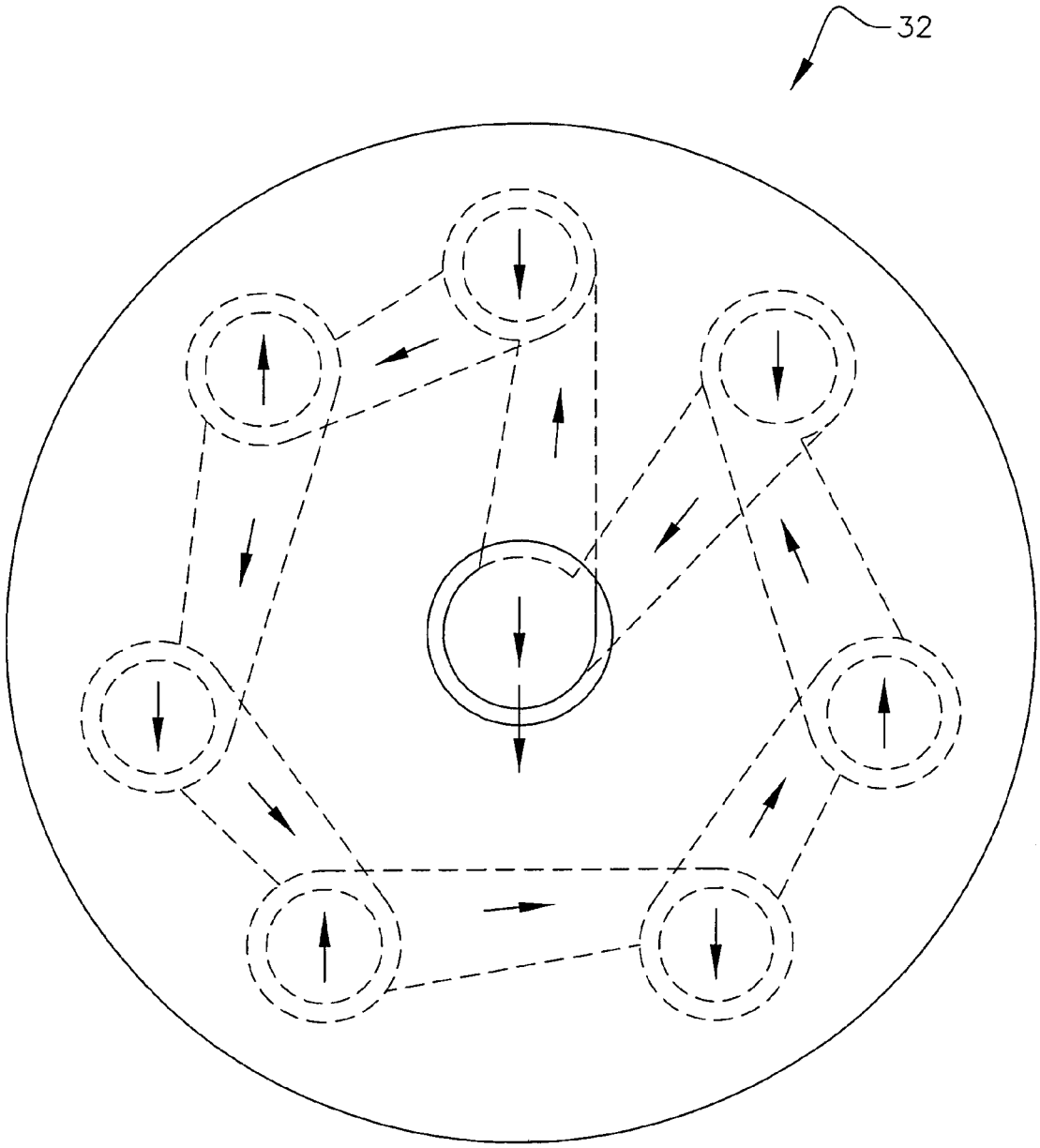
FIG. 14 is a top plan view depicting the flow path of the novel pressure spike attenuator.
Figure 15:
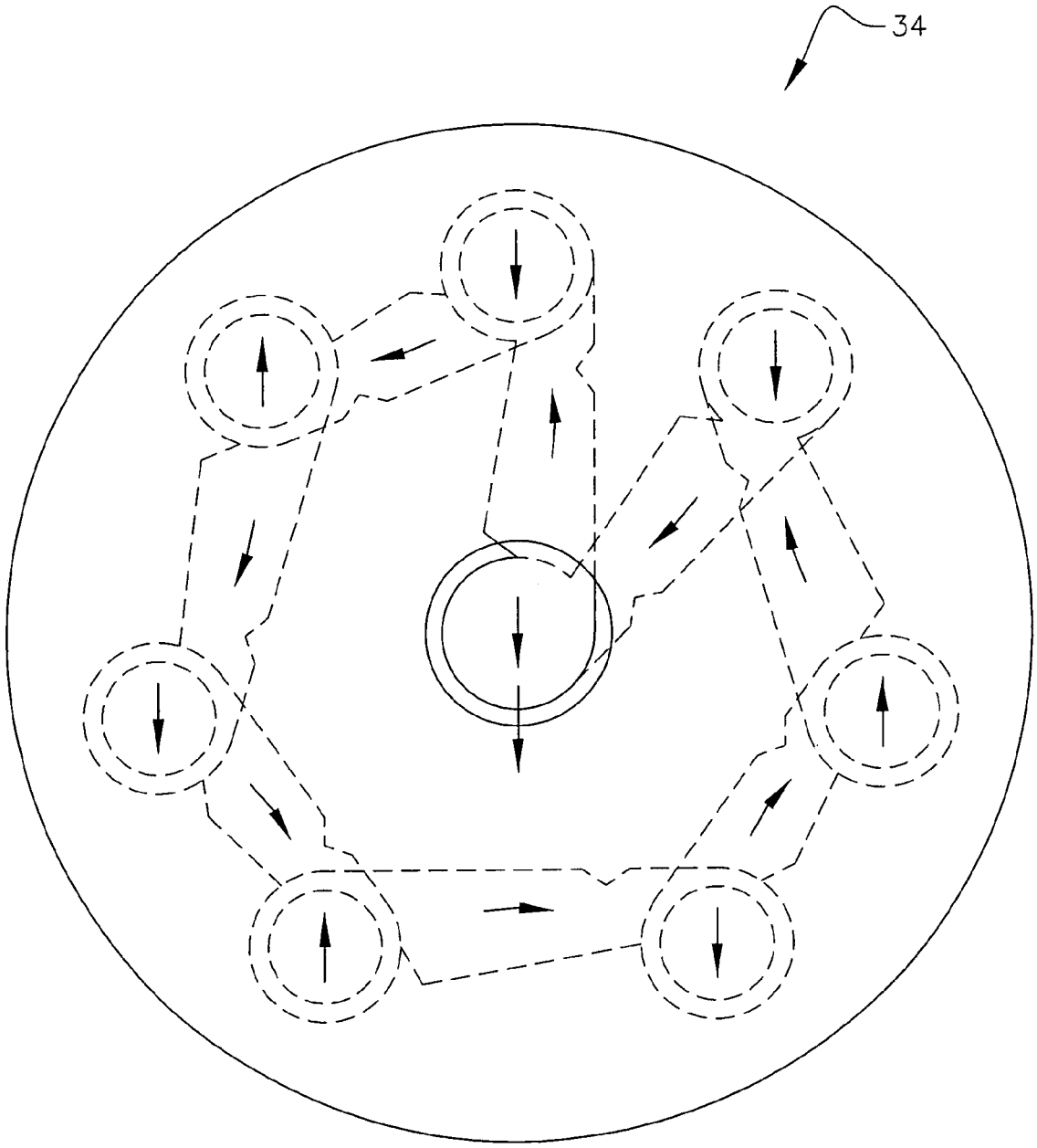
FIG. 15 is a top plan view depicting the flow path of the novel static mixer.

The flow paths created by stacking the appropriate five (5) flow chambers together to form the novel multi-stage restrictor, pressure spike attenuator, and static mixer are respectively depicted in FIGS. 13-15. An upwardly pointed arrow indicates fluid flowing upwardly, i.e., out of the plane of the paper and a downwardly pointed arrow indicates fluid flowing downwardly, i.e., into the plane of the paper. Arrows that are neither up nor down indicate paths of travel of fluid as it flows from a circular lobe in a pair grouping in a flow chamber to a circular lobe in a different pair grouping in a different flow chamber.

In this way, a very small yet effective hole restrictor is made by linking together a series of flow chambers. The flow chamber configuration includes two opposing circular lobes connected by a thin rectangular channel. A series of discrete flow channels are interconnected to provide a continuous serial flow path. A fluid enters a single hole into the flow channel network, and exits a single hole one hundred eighty degrees (180°) from the entry point. The degrees of restriction are controlled by the minimum passage of the discrete flow passages, the angle of the rectangular channel, and the number of sets of plates.

In a first embodiment, one side of the rectangular channel is variable in angle for parallel from the opposing side, thereby creating a taper and imparting increased or decreased energy into the fluid, depending upon the direction of fluid flow. In a second embodiment, the angle of taper is increased, and in a third embodiment, protuberances are added to each tapered channel.

In high power fluid systems such as hydraulics, pressure spikes must be managed to protect system instrumentation such as expensive pressure transducers. The unique internal configuration of the novel micro-flow device allows for clipping of pressure spikes without compromising system pressure to be monitored. Manipulation of component variables can be optimized for unique system requirements. The conventional practice of using sintered metal disks in place of prior art flow disks is problematic because the sintering process disallows high fidelity repeatable performance and pressure spikes can degrade sintered metal disks shedding contaminants.

The variable angle wall of the flow channel plays an instrumental role in quelling pressure spike gradually through the disk. The sequence of tapered walls creates a series of low to high pressure quelling zones. Alternatively, a single small hole restrictor is prone to clog and will clip the pressure spike harshly thereby sending a reverberating pressure wave in an opposite direction.

Micro-flow mixers are required in several analytical and processing areas of various sciences. Mixtures of very minute amounts of substances are required. Mechanical mixers are too large and have moving parts that wear out. The novel device has utility as a micro static mixer. By adding another feature to the flow path, a fore and aft chevron to the angled flow channel, excellent mixing is achieved on gaseous and Newtonian-type fluids. The added chevrons induce eddy current formation into the primary flow path. The severely angled wall creates a pulsation effect and the chevrons create an eddy current rotation, i.e., turbulence. The combination of the two accentuated effects together with the serial flow through the discrete flow channels creates a uniquely effective static micro-mixer.

The individual disks are preferably formed of metallic materials such as high-grade stainless steels, titanium, and the like. The construction is homogenous, i.e., the same material is used for the manufacturing of all plates.

Each single multi-stage restrictor, pressure spike attenuator and static mixer described forms a single stack having a diameter or thickness of 0.05 in., each of the 5 plates in the preferred embodiment being 0.01 in. The thickness of each plate used may vary depending on the system pressure the flow cell will be used within. Other designs can also use larger or smaller outside diameters with varying numbers of flow chambers. Each set of plates makes a single flow cell. It is possible to stack flow cells on top of each other if necessary.

It has also been found that construction of the fluid manipulation plates presents some tolerance production questions. While the fluid manipulation plates can be manufactured to the tolerances needed, the process is sloppy. It has been found that tolerances are easier to handle if the fluid manipulation plates used in the stack are themselves formed from two or more identical and thinner plates. For instance, the production of the fluid manipulation plates could be by use of two identical 0.005 in plates that would together form the fluid manipulation plates described herein. Thus it is clearly within the scope of this invention and the definition of the manipulation plate as described and claimed herein that it could itself be formed from two or more thinner and identical plates for ease of manufacturing. Thus, although not shown in the drawings, each of the fluid manipulation plates shown and defined herein, i.e. 24, 28, 24*a*, 28*a*, 24*b*, 28*b* could each be formed from two or more identical thinner plates. Thus a single flow cell could be formed from the five-plate configuration, or a seven or nine plate configuration if the fluid manipulation plates are produced as described in this paragraph.

One method of combining the set plates into a single flow cell is by fusion of the plates together without using an additional bonding agent.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A static mixer, comprising:

an inlet plate having a central non-restrictive aperture formed therein;

a top fluid manipulation plate;

a plurality of circular lobes formed in said top fluid manipulation plate;

an elongate channel interconnecting pairs of said circular lobes;

each of said elongate channels having a taper formed therein so that said elongate channels reduce in width along their respective extents;

said taper being between fifteen to thirty degrees;

a pair of chevron-shaped protuberances being formed in each of said elongate channels at opposite ends of said elongate channels and in opposite sides thereof;

an inter link plate having a plurality of non-restrictive apertures formed therein about the periphery thereof;

a bottom fluid manipulation plate;

a plurality of circular lobes formed in said bottom fluid manipulation plate;

an elongate channel interconnecting pairs of said bottom fluid manipulation plate circular lobes;

each of said elongate channels of said bottom fluid manipulation plate having a taper formed therein so that said elongate channels reduce in width along their respective extents;

said taper being between fifteen to thirty degrees;

a pair of chevron-shaped protuberances being formed in each of said elongate channels of said bottom fluid manipulation plate at opposite ends of said elongate channels and in opposite sides thereof; and an outlet plate having a central non-restrictive aperture formed therein.

* * * * *